US012241223B2

(12) United States Patent
Meschke et al.

(10) Patent No.: US 12,241,223 B2
(45) Date of Patent: Mar. 4, 2025

(54) PNEUMATIC EXCAVATOR AND METHODS OF USE

(71) Applicant: Sonny's HFI Holdings, LLC, Wilmington, DE (US)

(72) Inventors: Timothy Meschke, Carver, MN (US); Ian Taylor, Inver Grove Heights, MN (US); Nathan Schlueter, Bloomington, MN (US)

(73) Assignee: Sonny's HFI Holdings, LLC, Wilmington, DE (US)

( * ) Notice: Subject to any disclaimer, the term of this patent is extended or adjusted under 35 U.S.C. 154(b) by 0 days.

(21) Appl. No.: 18/416,024

(22) Filed: Jan. 18, 2024

(65) Prior Publication Data

US 2024/0254725 A1 Aug. 1, 2024

Related U.S. Application Data

(60) Provisional application No. 63/441,957, filed on Jan. 30, 2023.

(51) Int. Cl.
*E02F 3/92* (2006.01)
*E02F 3/88* (2006.01)
*E02F 3/90* (2006.01)

(52) U.S. Cl.
CPC ..... *E02F 3/9206* (2013.01); *E02F 3/8891* (2013.01); *E02F 3/902* (2013.01)

(58) Field of Classification Search
CPC . E02F 3/8891; E02F 3/92; E02F 3/902; E02F 3/9206; E02F 3/9218; E02F 3/925; E02F 3/9262; E02F 5/287
See application file for complete search history.

(56) References Cited

U.S. PATENT DOCUMENTS 521,883 A 6/1894 Holland
3,125,819 A 3/1964 Kaufman
(Continued)

FOREIGN PATENT DOCUMENTS

EP 0251660 A1 1/1988
EP 0566543 A1 10/1993
(Continued)

OTHER PUBLICATIONS

Invitation to Pay Additional Fees dated Apr. 26, 2024 in connection with International Patent Application No. PCT/US2024/013280, 4 pages.
(Continued)

*Primary Examiner* — Tara Mayo
(74) *Attorney, Agent, or Firm* — Dorsey & Whitney LLP

(57) ABSTRACT

A pneumatic excavator for delivering pulsed compressed air includes an actuator; a controller valve; a flow valve; a barrel defining an outlet of the excavator; and a pulse control line extending between the controller valve and a port downstream from an egress of the flow valve. As compressed air flows through the egress of the flow valve, the pulse control line is pressurized and shifts the controller valve to an actuated position, causing the compressed air from the actuator to close the flow valve, thus preventing the air flow from passing through a primary flow passage and through the outlet. The pulse control line being no longer pressurized by the air flow, then causes the controller valve to move to an unactuated position to cause compressed air from the actuator open the flow valve and permit the air flow through the outlet and again pressurize the pulse control line.

17 Claims, 12 Drawing Sheets

(56) References Cited

U.S. PATENT DOCUMENTS

| | | | |
|---|---|---|---|
| 3,670,514 | A | 6/1972 | Breston et al. |
| 3,881,530 | A | 5/1975 | Faldi |
| 4,114,723 | A | 9/1978 | Paitson et al. |
| 4,176,487 | A | 12/1979 | Manis |
| 4,253,255 | A | 3/1981 | Durell |
| 4,331,140 | A | 5/1982 | Hallsey |
| 4,377,168 | A | 3/1983 | Rzasa et al. |
| 4,412,656 | A | 11/1983 | Beck |
| 4,936,031 | A | 6/1990 | Briggs et al. |
| 4,991,321 | A | 2/1991 | Artzberger |
| 5,016,717 | A | 5/1991 | Simons et al. |
| 5,140,759 | A | 8/1992 | Artzberger |
| 5,170,943 | A | 12/1992 | Artzberger |
| 5,186,392 | A | 2/1993 | Pleshek |
| 5,212,891 | A | 5/1993 | Schuermann et al. |
| 5,220,935 | A | 6/1993 | Bailey et al. |
| 5,244,364 | A | 9/1993 | Laco et al. |
| 5,263,504 | A | 11/1993 | Bailey et al. |
| 5,487,229 | A | 1/1996 | Nathenson et al. |
| 5,782,414 | A | 7/1998 | Nathenson |
| 5,785,067 | A | 7/1998 | Kosofsky |
| 5,803,982 | A | 9/1998 | Kosofsky et al. |
| 5,806,616 | A | 9/1998 | Enlund et al. |
| 5,832,974 | A | 11/1998 | Jou |
| 5,860,232 | A | 1/1999 | Nathenson et al. |
| 5,966,847 | A | 10/1999 | Nathenson et al. |
| 5,976,268 | A | 11/1999 | Eliason et al. |
| 5,993,117 | A | 11/1999 | Lancaster et al. |
| 5,996,847 | A | 12/1999 | Smolen et al. |
| D435,207 | S | 12/2000 | Nathenson et al. |
| 6,158,152 | A | 12/2000 | Nathenson et al. |
| 6,202,330 | B1 | 3/2001 | Bolton |
| 6,283,340 | B1 | 9/2001 | Waldner |
| 6,397,878 | B1 | 6/2002 | Nolan |
| 6,470,605 | B1 | 10/2002 | Gilman et al. |
| 6,615,849 | B1 | 9/2003 | Gilman et al. |
| 6,618,966 | B2 | 9/2003 | Russo et al. |
| 7,475,831 | B2 | 1/2009 | Van et al. |
| 7,631,444 | B1 | 12/2009 | Hursen |
| 7,676,965 | B1 | 3/2010 | Nathenson et al. |
| 7,677,476 | B2 | 3/2010 | Burdsall et al. |
| 9,056,328 | B2 | 6/2015 | Giovannini |
| 9,382,688 | B2 | 7/2016 | Buckner |
| 9,475,174 | B2 | 10/2016 | Hursen |
| 9,855,573 | B2 | 1/2018 | Hursen |
| D865,120 | S | 10/2019 | Tibell et al. |
| 10,603,780 | B2 | 3/2020 | Hursen |
| 10,792,681 | B2 | 10/2020 | Alves |
| 10,920,397 | B2 | 2/2021 | Buchleiter et al. |
| 11,278,940 | B2 | 3/2022 | Takada et al. |
| 2006/0065309 | A1 | 3/2006 | Leasure et al. |
| 2008/0040945 | A1 | 2/2008 | Buckner |
| 2009/0255272 | A1 | 10/2009 | Tibell |
| 2009/0284068 | A1 | 11/2009 | Yu et al. |
| 2010/0095559 | A1 | 4/2010 | Buckner |
| 2010/0196129 | A1 | 8/2010 | Buckner |
| 2011/0296646 | A1 | 12/2011 | Showley |
| 2012/0007009 | A1 | 1/2012 | Yie |
| 2013/0185966 | A1 | 7/2013 | Harrington |
| 2013/0189060 | A1 | 7/2013 | Lamonte |
| 2013/0340297 | A1 | 12/2013 | Buckner |
| 2014/0020268 | A1* | 1/2014 | Buckner ..... E02F 3/8891 37/304 |
| 2014/0130382 | A1 | 5/2014 | Harrington |
| 2014/0231326 | A1 | 8/2014 | Biley et al. |
| 2015/0176243 | A1 | 6/2015 | Buckner |
| 2016/0207057 | A1 | 7/2016 | Hursen |
| 2020/0070180 | A1 | 3/2020 | Tibell |
| 2023/0080378 | A1 | 3/2023 | Richter et al. |
| 2024/0254723 | A1 | 8/2024 | Meschke et al. |
| 2024/0254724 | A1 | 8/2024 | Meschke et al. |
| 2024/0254726 | A1 | 8/2024 | Meschke et al. |

FOREIGN PATENT DOCUMENTS

| | | | |
|---|---|---|---|
| EP | 1803980 | A1 | 7/2007 |
| WO | 2017217916 | A1 | 12/2017 |
| WO | 2024163314 | A2 | 8/2024 |

OTHER PUBLICATIONS

International Search Report and Written Opinion dated Jul. 10, 2024 in connection with International Patent Application No. PCT/US2024/013280, 17 pages.

Notice of Allowance and Fee(s) Due and Notice of References Cited dated Dec. 6, 2024 in U.S. Appl. No. 18/416,050, 23 pages.

* cited by examiner

PNEUMATIC EXCAVATOR AND METHODS OF USE

CROSS-REFERENCE TO RELATED APPLICATIONS

This application claims the benefit of U.S. Provisional Patent Application No. 63/441,957, filed Jan. 30, 2023, and entitled "PNEUMATIC EXCAVATOR AND METHODS OF USE", which relates to commonly owned U.S. Provisional Patent Application No. 63/441,954, filed Jan. 30, 2023, entitled "PNEUMATIC EXCAVATOR AND METHODS OF USE", U.S. Provisional Patent Application No. 63/441,961, filed Jan. 30, 2023, entitled "PNEUMATIC EXCAVATOR AND METHODS OF USE", and U.S. Provisional Patent Application No. 63/441,966, filed Jan. 30, 2023, entitled "PNEUMATIC EXCAVATOR AND METHODS OF USE", each of which are herein incorporated by reference in their entireties for any useful purpose.

TECHNICAL FIELD

Implementations are directed to excavators, and more particularly to hand-held pneumatic excavators and methods of use.

BACKGROUND

Compressed air excavators cause compressed air to exit from a nozzle disposed at an end of an open pipe, which may be useful in operations such as loosening soil from buried pipes, gas mains, cables and cleaning. In prior approaches, pressurized water directed at the soil resulted in the generation of hazardous waste by the water mixing with contaminants in the soil that requires special treatment prior to disposal. In other approaches, mechanical digging implements such as blades and picks having hard cutting edges often damage the objects to be excavated or cleaned. The use of compressed air has the advantage of avoiding generation of hazardous waste while loosening soil without causing damage to the object targeted.

SUMMARY

Pneumatic excavators configured for delivering pulsed compressed air and methods of use are thus provided. According to implementations, a pneumatic excavator configured for delivering pulsed compressed air includes an actuator; a controller valve fluidly coupled to the actuator by at least one air conduit; a flow valve fluidly coupled to the controller valve by at least one port of the flow valve; a barrel coupled to an egress of the flow valve, wherein an egress of the barrel defines an outlet of the pneumatic excavator; and a pulse control line configured as an air conduit extending between the controller valve and a port of the primary flow passage downstream from the egress of the flow valve. A primary flow passage is defined at least by the flow valve and the barrel. As air from a compressed air supply flows through the primary flow passage, the pulse control line may be pressurized by the air and causes a spool pilot of the controller valve to be pressurized and to shift the controller valve to an actuated position to cause the compressed air to be delivered to a port of the at least one port of the flow valve such that the flow valve moves to a closed position and prevents the air from the compressed air supply from flowing through the primary flow passage. Upon the flow valve moving to the closed position, the pulse control line may no longer be pressurized and the controller valve may shift to an unactuated position to cause the compressed air to be delivered to another port of the at least one port of the flow valve such that the flow valve opens and permits the air from the compressed air supply to flow through the primary flow passage and again pressurize the pulse control line, whereby pulsed compressed air is delivered through the primary flow passage of the pneumatic excavator.

In various implementations and alternatives, the controller valve may further include a spool, where when the spool pilot is pressurized, the spool may be caused to shift to thereby move the controller valve to the actuated position, and when the spool pilot is no longer pressurized, the spool may shift to thereby move the controller valve to the unactuated position. In such implementations and alternatives, the spool may be biased by a biasing mechanism, and when the spool pilot is not pressurized, the spool may be in a normal position. For instance, the biasing mechanism may be a return spring.

In various implementations and alternatives, the controller valve may further include an adjustment device configured to control a pulse rate of the pulsed compressed air. For instance, the adjustment device may be configured to control an orifice size of the pulse control line.

In various implementations and alternatives, the controller valve may further include a selector switch configured to move between at least two positions, where in a first position of the selector switch, the pneumatic excavator may be configured to deliver the pulsed compressed air, and in a second position of the selector switch, the pneumatic excavator may be configured to deliver a constant flow of the air from the compressed air supply through the primary flow passage. For instance, during the constant flow of the air through the primary flow passage while the actuator is actuated, the compressed air may be transmitted by the at least one air conduit to the at least one port of the flow valve via the controller valve such that the compressed air causes the flow valve to move to the open position to thereby permit air from the compressed air supply to flow through the primary flow passage. Alternatively, during the constant flow of the air through the primary flow passage while the actuator is actuated, the controller valve may not be pressurized.

In various implementations and alternatives, actuating the actuator may cause the air from the compressed air supply to flow through the primary flow passage.

According to other implementations, a method of delivering pulsed compressed air through a pneumatic excavator comprising an actuator, a controller valve, and a primary flow passage defined at least by a flow valve, a barrel and a nozzle defining an outlet of the pneumatic excavator, and the method may involve providing, from a compressed air supply, a constant supply of compressed air to the pneumatic excavator. Then actuating the actuator, where in a first phase of actuation, the actuator delivers a first portion of compressed air to a port of the flow valve such that the first portion of compressed air moves the flow valve to an open position to thereby open the flow valve and permit a second portion of compressed air to pass through the primary flow passage. In this first phase of actuation, the controller valve is in an unactuated position. In a second phase of actuation, a pulse control line of the controller valve is pressurized by the second portion of the compressed air passing through the primary flow passage and causes the controller valve to be pressurized and to shift to an actuated position to cause the actuator to deliver compressed air to another port of the flow valve such that the flow valve moves to a closed position and prevents the second portion of compressed air to pass through the primary flow passage. Upon the flow valve moving to the closed position, the pulse control line and the controller valve are no longer pressurized such that the spool shifts to the unactuated position such that the actuator returns to the first phase of actuation and thereby permits the second portion of compressed air to pass through the primary flow passage and again pressurize the pulse control line, whereby pulsed compressed air is delivered through the primary flow passage of the pneumatic excavator.

In various implementations and alternatives, when the actuator is not actuated, the first portion of compressed air may be transmitted from the actuator to the flow valve via the controller valve such that the first portion of compressed air holds the piston of the flow valve in the closed position to thereby prevent the second portion of compressed air from passing through the flow valve.

In various implementations and alternatives, in the first phase of actuation, the first portion of compressed air is delivered to a first port of the at least one port of the flow valve such that the first portion of compressed air holds the piston in the open position, and in the second phase of actuation, the first portion of compressed air is delivered to a second port of the at least one port of the flow valve such that the first portion of compressed air holds the piston in the closed position.

In various implementations and alternatives, the method may further involve using a selector switch to select a pulse mode of operation of the pneumatic excavator such that the pulsed compressed air is provided through the primary flow passage. Such implementations and alternatives may further involve using the selector switch to select a constant flow mode of operation of the pneumatic excavator, and when the constant flow mode of operation is selected, the pulse control line and the spool pilot are inactivated and the first portion of compressed air from the second air hose fluidly couples to the first port of the flow valve and air holds the piston in the open position to thereby open the flow valve and permit the second portion of compressed air to pass therethrough and through the primary flow passage.

In various implementations and alternatives, the method may further involve releasing the actuator such that the actuator is not actuated and the first portion of compressed air is transmitted from the actuator to the first air hose and holds the piston of the flow valve in the closed position to thereby prevent the second portion of compressed air from passing through the flow valve.

In various implementations and alternatives, the method may further involve venting the flow valve when the flow valve is in at least one of the open position or the closed position.

DETAILED DESCRIPTION

Figure 1:
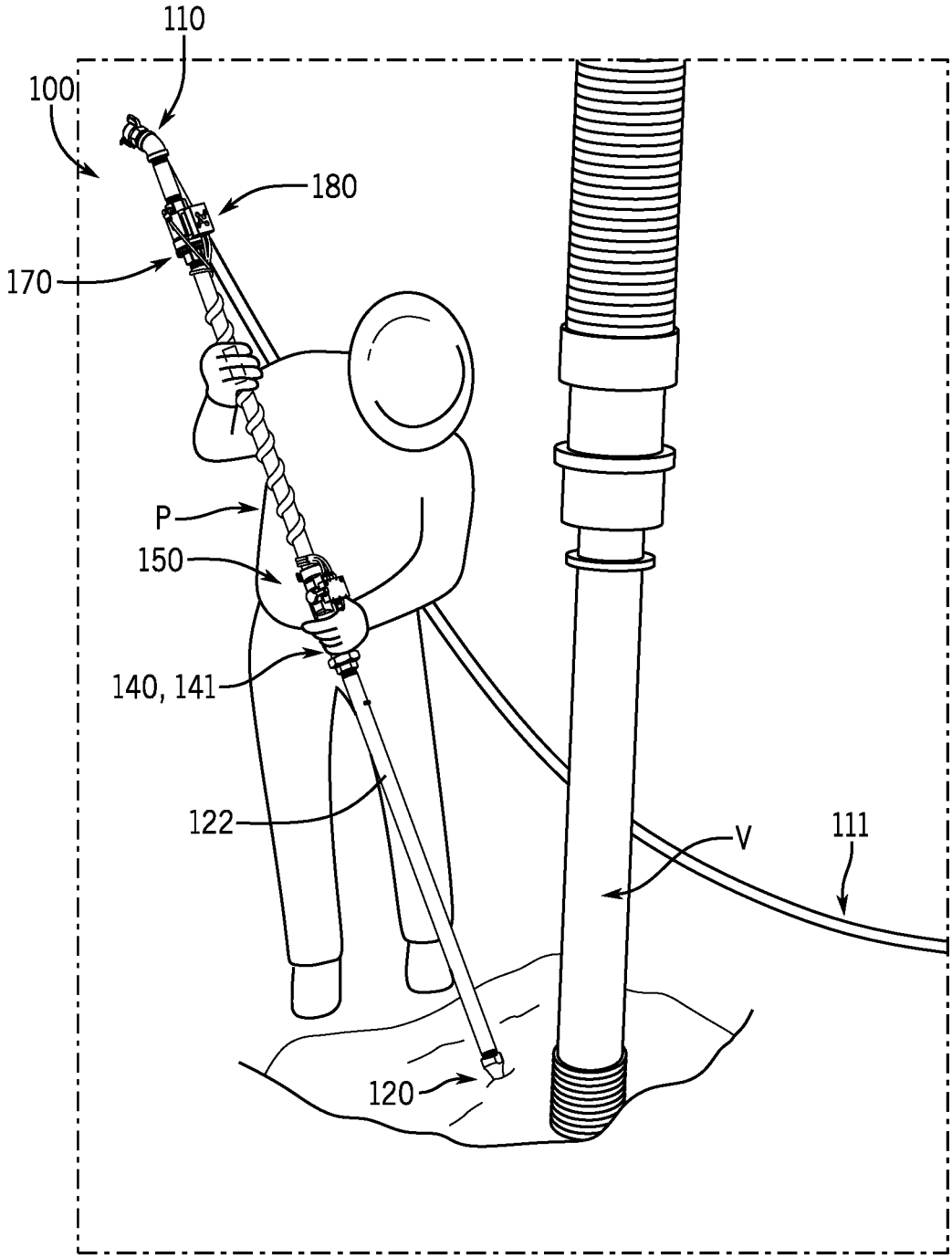
FIG. 1 illustrates a pneumatic air excavator in use in an excavating operation, according to implementations of the present disclosure.

Turning to the Figures, FIG. 1 illustrates a pneumatic air excavator 100 of the present disclosure in an exemplary soil excavating operation. A proximal end 110 of the pneumatic air excavator 100 is removably coupled to an air supply via an elongated delivery line 111. The air supply may be compressed or pressurized air, which may be provided by an air compressor such as an air compressor truck. The air supply may be air (e.g., a mixture of oxygen and nitrogen), a gas or a mixture. A distal end 120 of the pneumatic air excavator 100 may include an extension 122 and a nozzle 130 (see, e.g., FIG. 2A) configured to deliver the compressed air, for instance, to break apart soil covering a buried target object, e.g., a pipe, cable, or other structure(s). A barrel 140 extending between the proximal and distal end 110, 120 of the pneumatic air excavator 100 may be held by a user P during use. The barrel 140 may include an actuator assembly 150 movably coupled to an exterior 141 of the barrel 140 by a releasable coupling 160 (see, e.g., FIG. 2A). The actuator assembly 150 may be held by one hand of the user P for controlling an on/off status of the pneumatic air excavator 100, while a different region of the pneumatic air excavator 100 may be held by the other hand of the user P, such as at a primary valve or flow valve 170, which may include a controller valve 180. As the soil is loosened during operation of the pneumatic air excavator 100, an industrial vacuum V may extract the loosened soil and may for instance deposit the soil in a location for future use or removal.

Figure 2A:
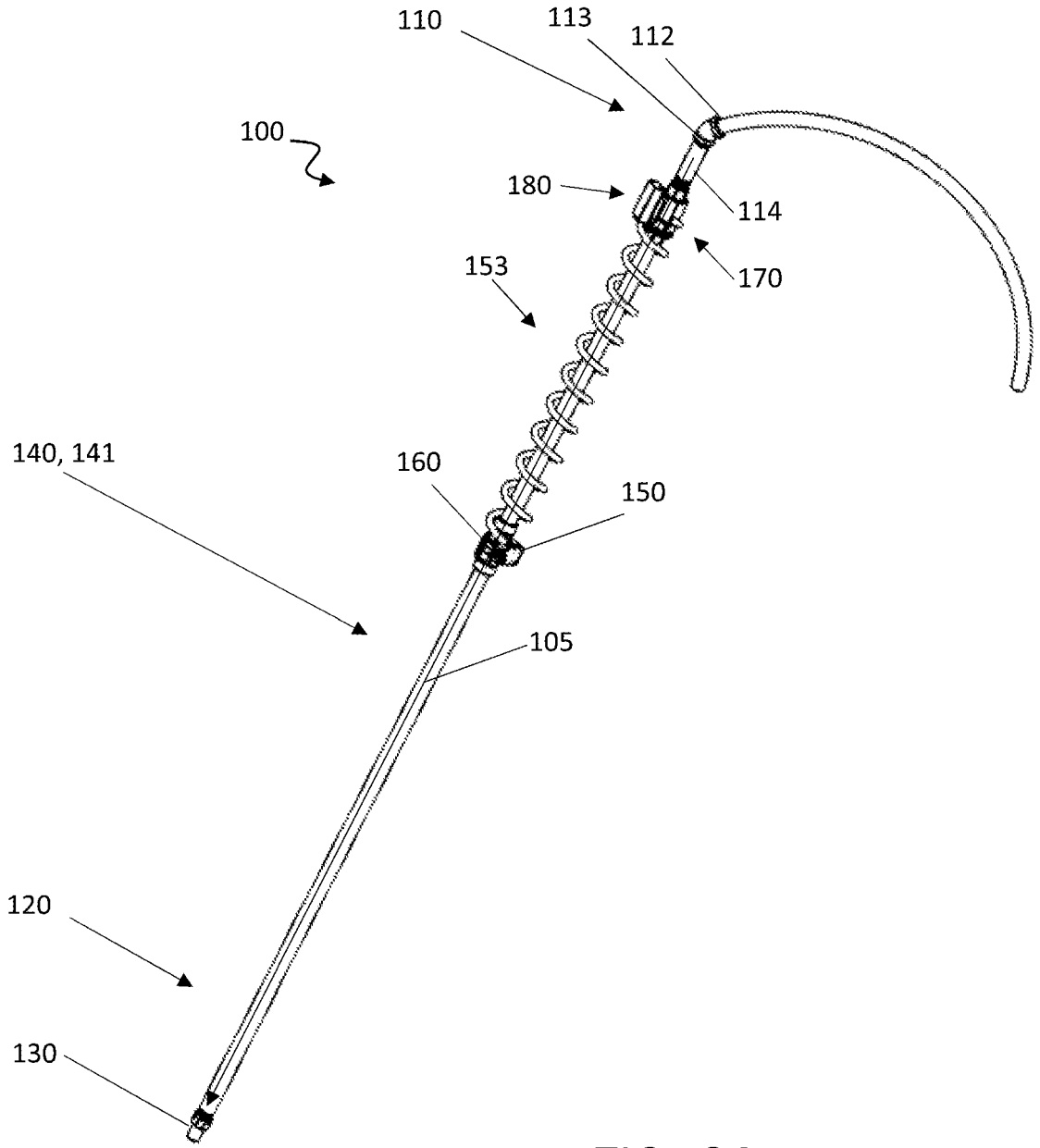
FIGS. 2A, 2B and 2C illustrate a first isometric view, an exploded isometric view, and a second isometric view, respectively, of the pneumatic air excavator, according to implementations of the present disclosure.
Figure 2B:
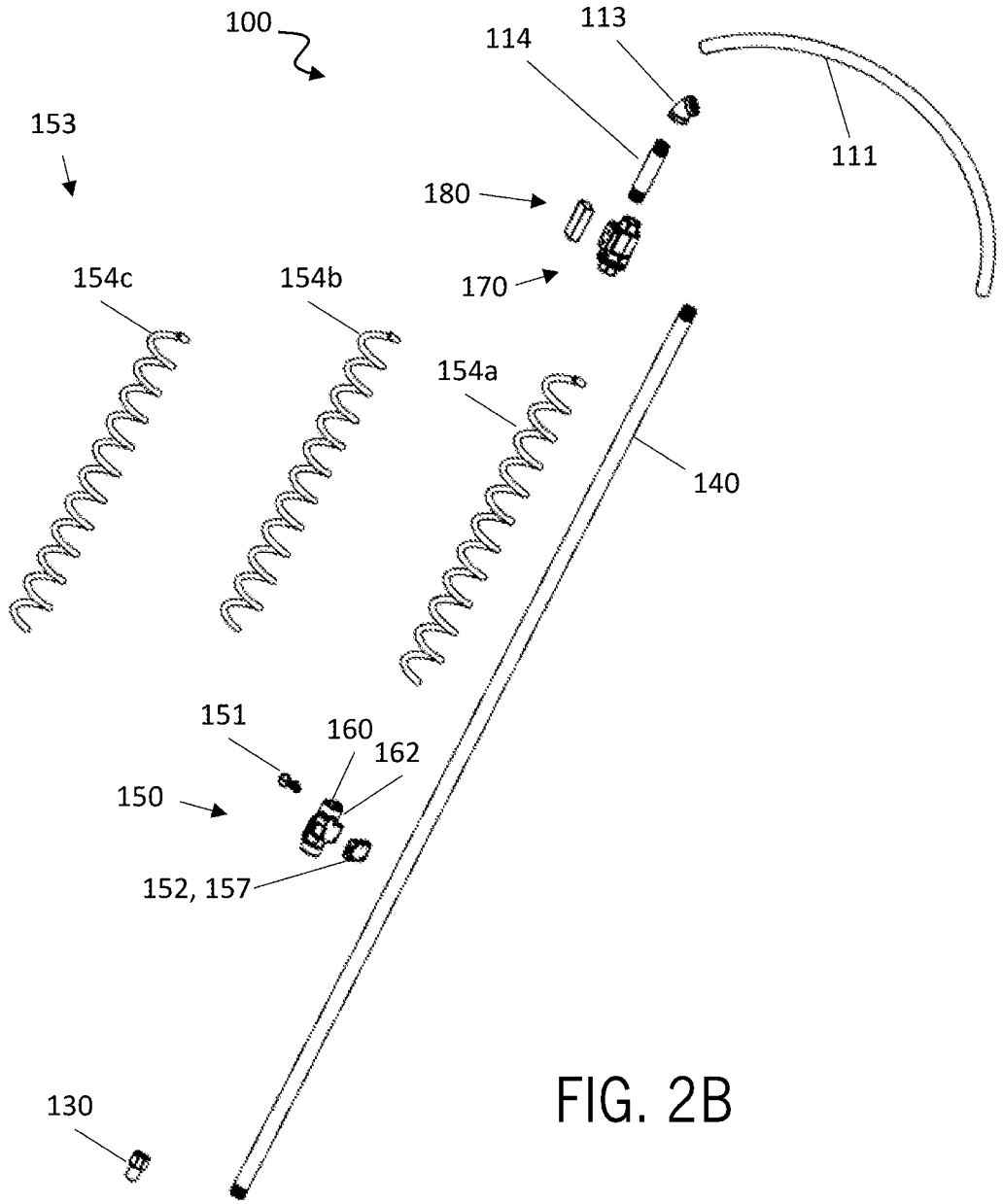

FIGS. 2A and 2B illustrate an isometric view and an exploded isometric view, respectively, of the pneumatic air excavator 100 of the present disclosure. As shown in FIG. 2A, components of the pneumatic air excavator 100 may be coaxially arranged such as the nozzle 130, barrel 140, portions of the actuator assembly 150, the releasable coupling 160, the primary flow valve 170, and the controller valve 180. A primary flow passage 105 of the pneumatic air excavator 100 may extend along a central axis thereof and may be defined at least by the flow valve 170, the barrel 140 and nozzle 130.

Figure 2C:
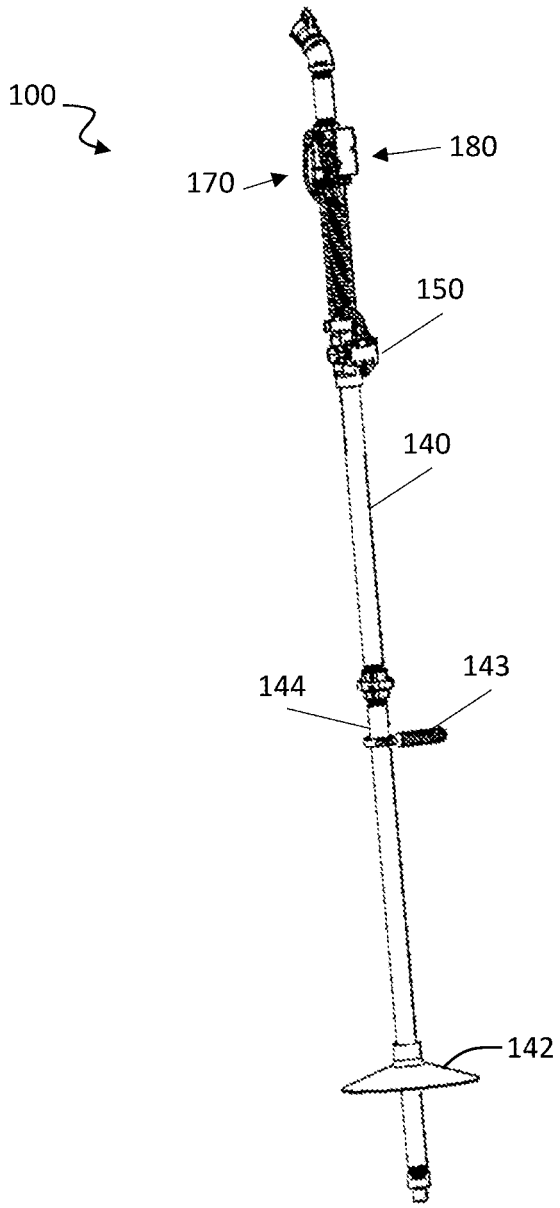
Figure 2D:
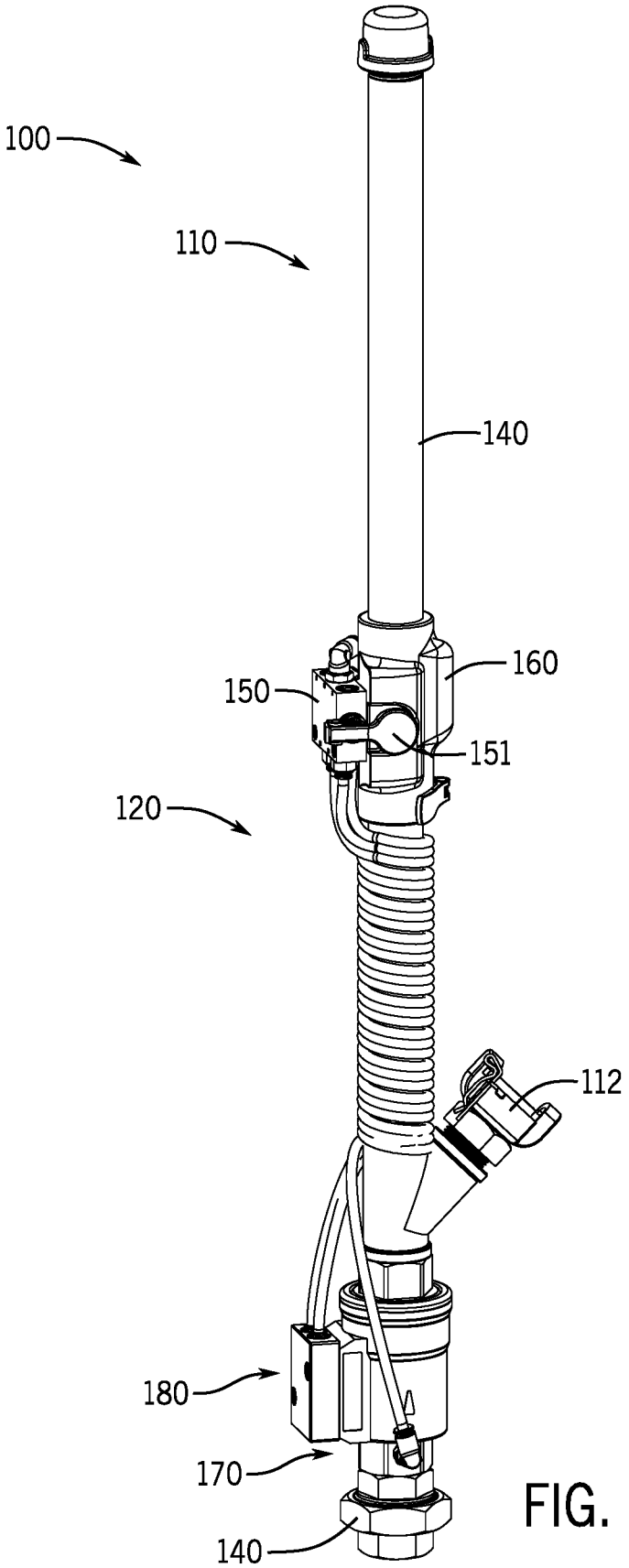
FIG. 2D shows the pneumatic air excavator with an alternative fitting position, according to implementations of the present disclosure.

At the proximal end 110 of the air excavator 100, a port or fitting 112 may be provided for removably connecting to the air supply via the delivery line 111 to establish a fluid coupling to the air supply. For instance the delivery line 111 may include a fitting that is complementary to the fitting 112, or the two may otherwise be configured for coupling to one another directly or indirectly to provide an air tight connection. For instance, the fitting 112 may be a quick connect fitting, a claw connector such as a Chicago claw connector, or other air supply connection. The proximal end 110 may optionally include an angled conduit or pipe 113 and/or a straight conduit or pipe 114, each of which may for instance facilitate ergonomics of using the pneumatic air excavator 100 when coupled to the delivery line 111. Alternatively, the port or fitting 112 may be positioned at a distal end 120 of the air excavator 100, as shown in FIG. 2D, and for instance may be arranged distal to the actuator assembly 150 and the releasable coupling 160. In such case, the barrel 140 extending between the proximal and distal ends 110, 120 may enable the releasable coupling 160 to be moved to various positions along the barrel 140 and locked thereto, and this portion of the barrel 140, in some instances, may not receive airflow from the air supply, and may thereby provide flexibility in the configuration of the releasable coupling 160 and the barrel 140. Arrangement of the port or fitting 112 at the distal end 120 may lower the center of gravity of the pneumatic excavator to a more centralized position, for instance to provide better ergonomics and reduce fatigue. In such examples, the barrel 140 may be arranged both at the inlet end 179 of the flow valve 170 and the outlet end 178 of the flow valve 170 as shown in FIG. 2D.

The distal end 120 of the pneumatic air excavator 100 may define an outlet and may include a nozzle 130 coupled thereto. For instance, the nozzle 130 may be coupled to an egress of the barrel 140, and the nozzle 130 may define an outlet for the pneumatic excavator 100. The nozzle 130 may have various configurations depending on the desired delivery pressure and flow geometry emitted therefrom. For instance, the nozzle 130 may have a supersonic nozzle design. The nozzle 130 may be constructed of various materials such as metal including brass, stainless steel, composites such as polymers, reinforced polymers, a combined construction of metallic and polymer materials, and combinations thereof. The type of nozzle may include but is not limited to 30-300 cubic feet per minute (cfm) at 70 to 250 psi. The nozzle 130 may be interchangeable with other nozzles and may be releasably coupled to the distal end 120 such as via a threaded engagement or other fastening mechanism, e.g., quick connect. Alternatively, the nozzle 130 may be non-detachably connected to the distal end 120 of the pneumatic air excavator 100. In addition or alternatively, the nozzle 130 may include a non-conductive cover or coating, e.g., a rubber, polymer, of the like, for protecting the air excavator 100 and user from electrical shocks during excavation operations near power sources.

In some implementations, the distal end 120 of the pneumatic air excavator 100 may be formed of an optional barrel extension 122 as illustrated in FIG. 1. The barrel extension 122 may have the same or a different configuration as the barrel 140 of the pneumatic air excavator 100 and may be detachably coupled to the barrel 140 such as via a threaded collar or via another fastening mechanism such as those disclosed herein. The barrel extension 122 may enable the user P to use the pneumatic air excavator 100 in excavation applications at varying depths, and for instance, a longer extension 122 may be joined to the barrel 140 when the target object has a depth that is deeper than the length of the barrel 140. This may enable the user P to operate the pneumatic air excavator 100 more comfortably, as the user may operate the system in a standing position instead of a kneeling or bent position. In some implementations, the extension 122 and the barrel 140 may be telescopically arranged, and the length of the pneumatic air excavator 100 may be adjustable, such as by operating an adjustment collar that permits telescopic movement of the extension 122 relative to the barrel 140. The extension 122 may be constructed of the same or different material from the barrel 140, and for instance may be constructed of a non-conductive material such as fiberglass, plastics, rubbers, polymers, lined or coated material, aluminum, and so on.

The barrel 140 may define a portion of the primary flow passage 105 of the pneumatic air excavator 100 for delivering compressed air to the nozzle 130. The barrel 140 may be configured as a rigid, elongated tubular conduit having an ingress and an egress, and the ends may be coupled to various components as described herein, e.g., the ingress may be coupled to the delivery line 111 and the egress may be coupled to the nozzle 130 in a detachable or non-detachable manner. The barrel 140 may be constructed of a non-conductive material such as fiberglass, plastics, rubbers, polymers, lined or coated material, aluminum, and so on. In some implementations, an adjustable shield 142 may be slidably arranged on the barrel 140 proximate the distal end (FIG. 2C). The adjustable shield 142 may be cone-shaped and may deflect debris during an excavation operation.

The actuator assembly 150 of the pneumatic air excavator 100 may be arranged along the barrel 140 as shown in FIGS. 2A, 2C and 2D. The actuator assembly 150 may generally include an actuation switch and may be releasably coupled to the barrel 140 by the releasable coupling 160 described herein. The actuation switch of the actuator assembly 150 may include a trigger 151, e.g., a push button, coupled to a trigger valve 152. The trigger 151 may be biased by a biasing mechanism such as a spring or a solenoid valve. For instance, the trigger valve 152 may include a spool valve with a spool and spool pilot, where the spool is biased by a biasing mechanism such as a spring or solenoid valve, and the trigger 151 may move the spool against the bias force of the biasing mechanism. An actuation conduit 153 may be coupled between the actuator assembly 150 and the flow valve 170, which may be movably adjustable as provided herein.

Operation of the actuation switch may cause the pneumatic air excavator 100 to be turned on and off. For instance, to activate the actuator assembly 150, the actuation switch may be moved to a closed position, e.g., by depressing the trigger 151. In response, the actuation conduit 153 coupled between the actuator assembly 150 and the flow valve 170 sends a signal to cause the main valve 170 to move to an open position, such that compressed gas from the delivery line 111 is permitted to pass through the main valve 170 as well as the primary flow passage 105 of the pneumatic air excavator 100 such that the compressed air exits through the nozzle 130. The actuator assembly 150 may be deactivated or released by the actuation switch moving to an open position, e.g., by releasing the trigger 151. Where the trigger valve 152 includes a biasing mechanism, deactivation may cause the trigger 151 to move under the force of the biasing mechanism moving to the unbiased state, e.g., to a normal position. For instance a return spring may be relaxed. In response, the actuation conduit 153 may send a signal to cause the flow valve 170 to move to a closed position to prevent the compressed gas from passing through the main valve 170 and thus the primary flow passage 105. The actuation conduit 153 may be a flexible conduit that can be extended and retracted along the barrel 140 of the pneumatic air excavator 100. For instance, the actuation conduit 153 may be configured as flexible air tubing (e.g., an air actuation conduit), as a flexible electrical conduit (e.g., a conductive wire), and may be coiled around the barrel 140, strung along the barrel 140, e.g., between the actuator assembly 150 and the flow valve 170, or may be telescopic along the barrel 140. In some implementations, a sleeve may cover the actuation conduit 153. The actuation conduit 153 may be provided as one or more conduits. For instance, one, two, three, four, five six, seven or more conduits may be provided in the actuation conduit.

Although the actuator assembly 150 is illustrated as being positioned on the releasable coupling 160, the actuator assembly 150 may alternatively be positioned on the flow valve 170 or another portion of the pneumatic air excavator 100. In addition or alternatively, although the actuator assembly 150 is illustrated as being positioned distal to the flow valve 170, the actuator assembly and, in some cases, the releasable coupling 160 carrying the actuator assembly 150, may alternatively be positioned proximal to the flow valve 170 of the pneumatic air excavator 100.

The releasable coupling 160 may be configured to releasably couple the actuator assembly 150 to the barrel 140 in a plurality of locked positions along a length of the barrel 140 when in a released position, and may be locked or fixed to the exterior 141 of the barrel 140 in the locked position. The releasable coupling 160 may include a sleeve-shaped portion 161 (FIG. 3) surrounding the barrel 140, which may be locked and unlocked by a locking mechanism 162 such as a clamp or a cam lock, e.g., clamping handle coupled to a split ring or clamp, for establishing a pinch, compression, and/or friction lock. The locking mechanism 162 may engage with the barrel 140 via a pinch or clamping mechanism along the external diameter of the barrel 140. In an unlocked position of the locking mechanism 162, the releasable coupling 160 may be in a released position and be moved or slid along the exterior 141 of the barrel 140, and due to the actuation conduit 153 being adjustable or flexible, movement of the releasable coupling 160 slaves the actuation conduit 153 along the barrel 140 of the pneumatic air excavator 100 (e.g., in an expansion or a retraction movement) and thus the coupling between the actuator assembly 150 and the flow valve 170 via the actuation conduit 153 can be maintained in any position of the actuator assembly 150 relative to the flow valve 170. The locking mechanism 162 of the releasable coupling 160 may be moved to a locked position to secure or lock the releasable coupling 160 to the exterior 141 of the barrel 140.

Figure 5A:
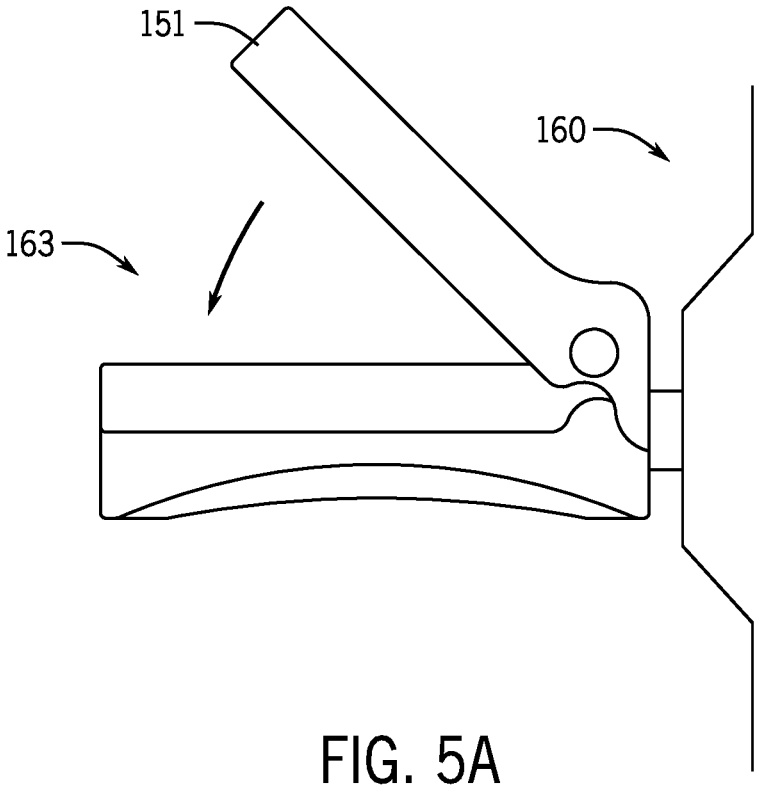
FIGS. 5A and 5B illustrate different positions of a handle of the pneumatic air excavator, according to implementations of the present disclosure.
Figure 5B:
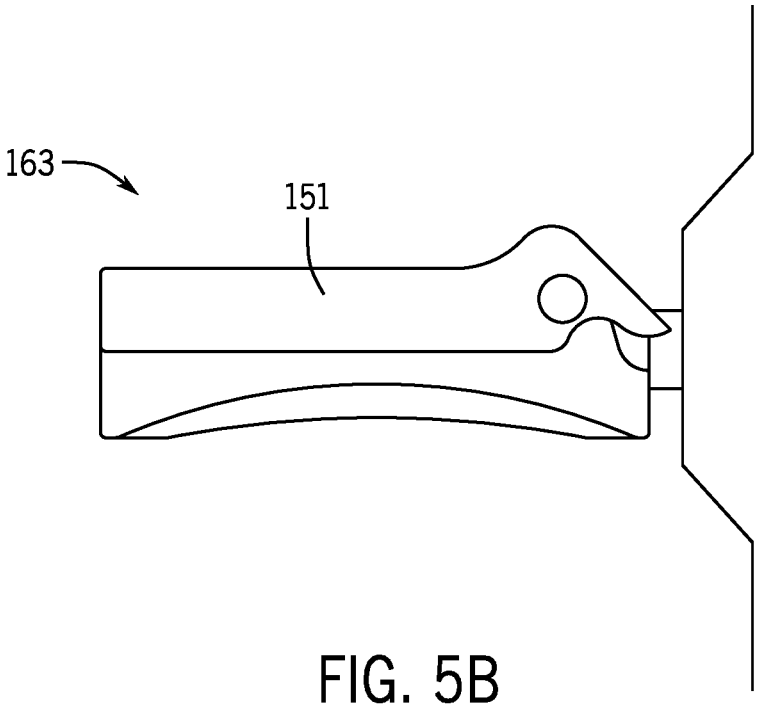

In some implementations, the sleeve-shaped portion 161 of the releasable coupling 160 may include the trigger 151 of the actuator assembly 150 coupled thereto, and for instance the trigger 151 may be arranged on or in the sleeve-shaped portion 161 to provide a user with a grippable portion via the sleeve-shaped portion that can be simultaneously used to actuate the actuator assembly 150 via the trigger 151 between an on and off state. In some implementations, the releasable coupling 160 may additionally include a handle 163 (FIGS. 5A and 5B), which may extend from the sleeve-shaped portion 161 and/or may be integrated with the sleeve-shaped portion 161. As shown in FIGS. 5A and 5B, the trigger 151 of the actuator assembly 150 may be integrated with the handle 163 of the releasable coupling 160 and the trigger 151 may be movable between an off position (FIG. 5A) and an on position (FIG. 5B). In some implementations, the handle 163 may be positioned perpendicularly, at an angle, or parallel relative to the releasable coupling 160 and the barrel 140. In addition, the handle 163 may be an adjustable handle that is adjustable to the aforementioned positions. It will be appreciated that the actuator assembly 150 and releasable coupling 160 may be integrated into an assembly configured to be held or gripped by a single hand of the user P to facilitate ergonomics and use of the pneumatic air excavator 100. In further implementations, a second handle 143 (FIG. 2C) may be releasably coupled to the barrel 140 using a second releasable coupling 144, e.g., a cam lock or clamp, and may be configured to be movable to a plurality of locked positions along the length of the barrel 140 independent from the releasable coupling 160.

Figure 3:
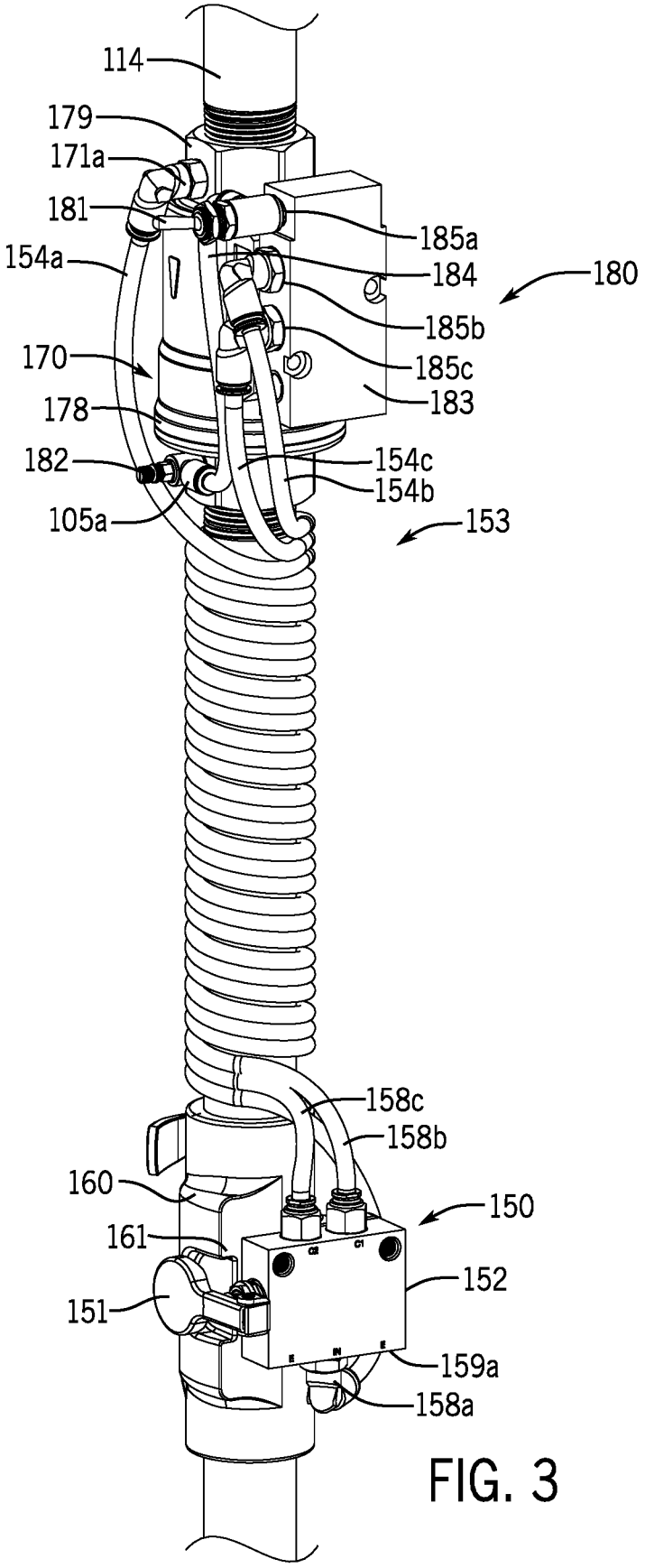
FIG. 3 illustrates a detail view of components of the pneumatic air excavator, according to implementations of the present disclosure.
Figure 4A:
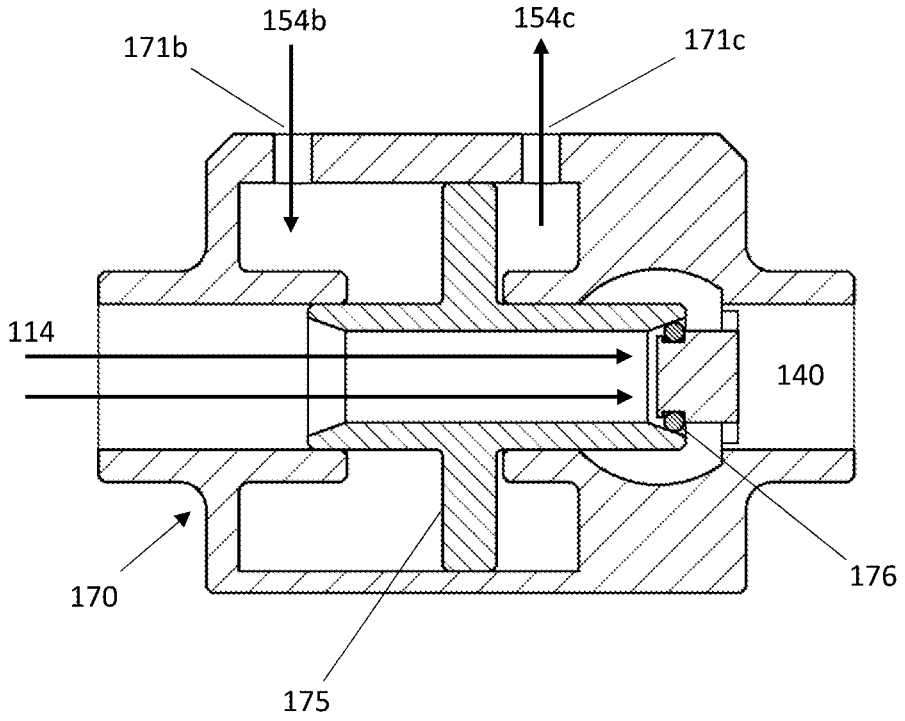
FIGS. 4A and 4B illustrate a valve of the pneumatic air excavator in a closed position and in an open position, respectively, according to implementations of the present disclosure.
Figure 4B:
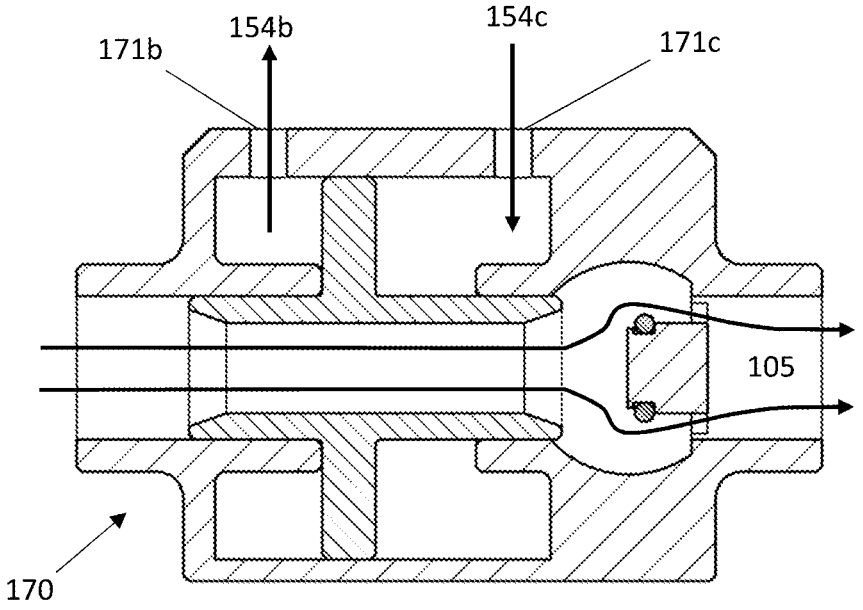

The flow valve 170 also referred to as a primary valve or main valve of the pneumatic excavator 100 may be arranged between the pipe 114 and the barrel 140 as illustrated in FIGS. 4A and 4B and may be responsible for delivering airflow through the pneumatic air excavator when in the actuated or open position. Referring to FIGS. 3, 4A and 4B, the flow valve 170 may include ports 171*a*, 171*b*, 171*c*, a piston 175, a valve seat 176, an outlet end 178 and an inlet end 179, where the portion of the flow valve 170 defining the primary flow passage 105 extends therebetween. In some implementations the flow valve 170 may be free of a return spring, such as where the flow valve 170 is pneumatically operated, while in other implementations, a mechanical biasing mechanism such as a return spring may be included in the flow valve 170. The flow valve 170 may be configured as a pneumatically piloted valve such as a coaxial valve, a double acting coaxial valve, or as a solenoid actuated coaxial valve, as a pneumatic actuated angle seat valve or as a pneumatically actuated ball valve.

Ports 171*a*, 171*b*, and 171*c* of the flow valve 170 may be coupled to the actuator assembly 150 via the actuation conduit 153. For instance, referring to FIGS. 2B and 3, the actuation conduit 153 may include at least two flexible air hoses, such as three air hoses 154*a*, 154*b*, and 154*c*. Air hose 154*a* may be configured as a constant pressure conduit, a first end of which may be coupled to the pneumatic air excavator 100 at a port 171*a* upstream from the piston 175 of the flow valve 170, and the air hose 154*a* may extend to and be coupled to the actuator assembly 150, e.g., at port 158*a*, at a second end. Although the port 171*a* is illustrated as being defined in the flow valve 170, it will be understood that the port 171*a* may be defined in other portions of the pneumatic excavator 100 upstream from the flow valve 170. The air hose 154*a* may be constantly supplied compressed air when the delivery line 111 transmits pressurized air. Air hoses 154*b*, 154*c* may each be coupled to respective other ports 171*b*, 171*c* of the main valve 170 and to respective ports 158*b*, 158*c* of the housing 157 of the actuator assembly 150.

In implementations of use, the pneumatic air excavator 100 may be pneumatically turned on and off using the same compressed air supply that is used to operate the pneumatic air excavator 100. For instance, the actuation conduit 153 may include air hoses, e.g., air hoses 154*a*, 154*b*, and 154*c*. The air hoses may receive compressed air from the delivery line 111 or may carry compressed air emitted from the actuator assembly 150 to the flow valve 170. For instance, the compressed air received by the actuator assembly 150 may be derived from the air supply from the delivery line 111, and thus the actuator assembly 150 may receive the same compressed air supply that is used to operate the pneumatic air excavator 100, e.g., when the flow valve 170 is open and the compressed air passes through the primary flow passage 105.

In implementations, actuation of the trigger 151 of the actuator assembly 150 may open a valve of the trigger valve 152, e.g., by movement of a spool against a biasing mechanism such as a return spring, to cause pressurized air from the actuator assembly 150 to enter the actuation conduit 153, e.g., air hose 154*c*, fluidly coupled to the main valve 170, and the actuation conduit 153 may deliver the pressurized air to a port, e.g., port 171*c*, of the main valve 170 to cause the main valve 170 to open and thereby permit pressurized air to flow through primary flow passage 105 of the pneumatic air excavator 100. Release of the trigger 151 may cause the trigger valve 152 to relax, for instance as a biasing force is released such as via relaxation of a spring, which may also cause pressurized air from the air supply to enter the actuation conduit 153, e.g., at air hose 154*b*, and be delivered to the main valve 170, but the pressurized air may be routed to another port, e.g., port 171*b* of the main valve 170 to close the main valve 170 and thereby prevent pressurized air from flowing through the primary flow passage 105 and exit the nozzle 130. Thus, the actuator assembly and the air hoses of the actuation conduit 153 may be configured to enable the actuator assembly 150 to pneumatically actuate and deactivate the pneumatic air excavator 100.

With reference to FIGS. 6A-6F, as well as FIGS. 3, 4A and 4B, the controller valve 180 is provided for controlling flow modes of the pneumatic excavator 100 when the actuator assembly 150 is actuated. The controller valve 180 may provide a fluid coupling between the actuator assembly and the flow valve 170, and for instance may be coupled to the actuator assembly 150 via the actuation conduit 153 and to the flow valve 170 at ports 171*b* and 171*c*, such as via exit ports of the controller valve 180 or via air conduits. The controller valve 180 may for instance include a selector to permit different flow modes of compressed air to be delivered through the nozzle 130, such as a pulsed flow of compressed air and a constant flow of compressed air. A pulsed compressed air mode may deliver a pulsed, sinusoidal wave-type of airflow through the nozzle 130, where peaks of the pulsed compressed air provide a higher impact impingement relative to a constant flow of compressed air. Delivery of pulsed compressed air may facilitate breaking up of compact materials and may additionally promote the use of less air in excavation operations. The sinusoidal nature of the pulsed air may also provide the advantage instantaneously delivering a greater flow of air than what the air supply or compressor is capable of outputting at a steady state. A constant flow mode of the controller valve 180 may result in compressed air being delivered constantly through the nozzle 130, e.g., in a smooth stream. The controller valve 180 may be pneumatically driven and may be fluidly coupled to the actuator assembly 150 and to the flow valve 170. Alternatively, the controller valve 180 may be configured as or include an electrical solenoid valve and may be electrically coupled to the actuator assembly 150 and the flow valve 170.

The controller valve 180 may include a selector switch 181 for the user P to select the flow mode from the controller valve 180; an adjustment device 182 for adjusting a frequency of pulsing when a pulsed flow mode is selected; a spool pilot 183; a pulse control line 184, e.g., a direct impingement line, configured as an air conduit that may extend between the controller valve 180, e.g., a selector switch 181 and a port 105*a* of the primary flow passage 105 (e.g., along the barrel 140) downstream from the flow valve 170 egress, and may be coupled to the adjustment device 182, as shown in FIG. 3; ports 185*a*, 185*b*, 185*c*, which may respectively be coupled to the pulse control line 184, the air hose 154*b*, and the air hose 154*c*; and exhaust ports 186, 189.

Figure 6A:
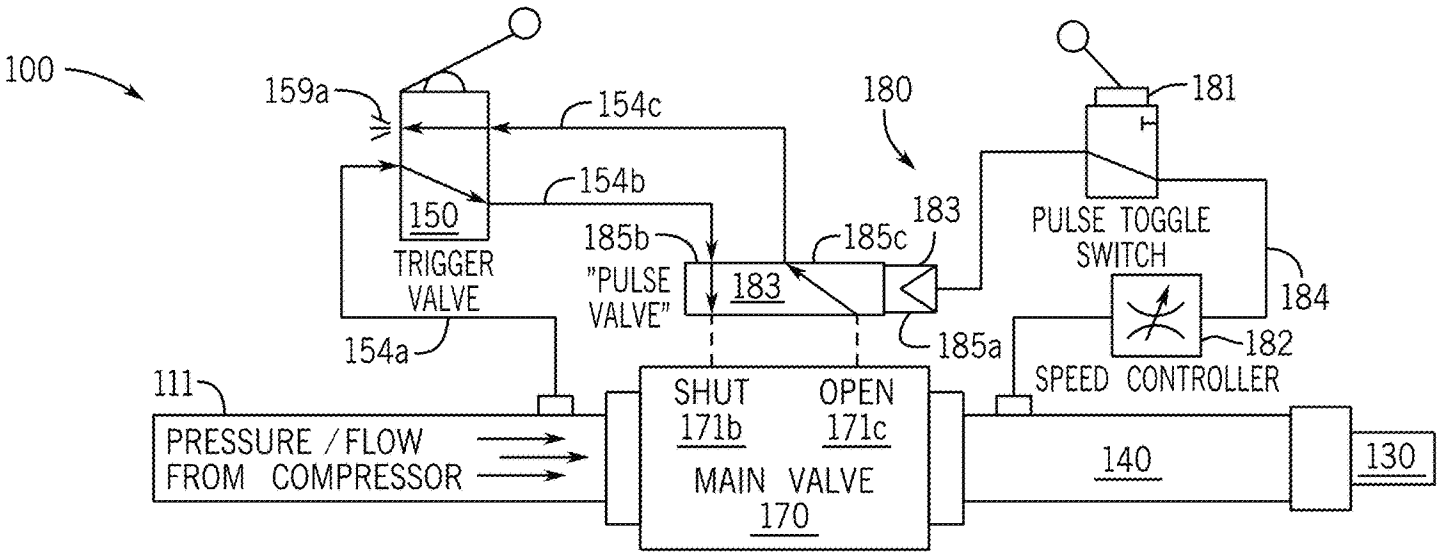
FIGS. 6A-6F illustrate pneumatic circuit diagrams of the pneumatic excavator including a controller valve for controlling flow modes of the pneumatic excavator, according to implementations of the present disclosure.

As described herein, the air hose 154*a* may be connected upstream of the flow valve 170 and constantly receive an air signal, e.g., may be constantly pressurized and be a constant pressure conduit of the actuator assembly 150. With reference to FIG. 6A, in the open position of trigger 151 (e.g., in an unactuated state), pressurized air is routed from the actuator assembly 150 to the air hose 154*b*, which extends to the controller valve 180 and to the flow valve 170, e.g., to the primary valve, port 171*b* such that the compressed air maintains and/or forces the flow valve 170 to the closed position as shown in FIG. 4A, e.g., the piston 175 remains seated in the valve seat 176 such that no compressed air flows through the primary flow passage 105 of the pneumatic air excavator 100.

When the trigger 151 of the actuator assembly 150 is pressed, the trigger valve 152, e.g., the spool of a spool valve, shifts and the compressed air is no longer delivered to the air hose 154*b*, and the pressure keeping the flow valve 170 shut is released or vented from the air hose 154*b*. In this state of the trigger 151, the constant pressure delivered to the actuator assembly 150 may then be directed to the air hose 154*c* to deliver compressed air to the controller valve 180 and into the port 171*c* of the flow valve 170 to push the piston 175 away from the valve seat 176 to thereby move the flow valve 170 to the open position as shown in FIG. 4B such that compressed air flows through the primary flow passage 105 and exits the nozzle 130.

During such operation of the actuator assembly 150, e.g., while air flows through the primary flow passage 105, then the selector switch 181 of the controller valve 180 can become functional and be operated to select an operational mode such as a pulse mode or a constant flow mode. When the switch is in, or moved to, the constant flow mode selection, the compressed air from the air hose 154*c* is directed from the controller valve 180 to the port 171*c* of the flow valve 170 such that the flow valve 170 is maintained in an open position to allow the compressed air from the delivery line 111 to constantly flow through the primary flow passage 105 and exit the nozzle 130 as shown in FIG. 4B.

Figure 6B:
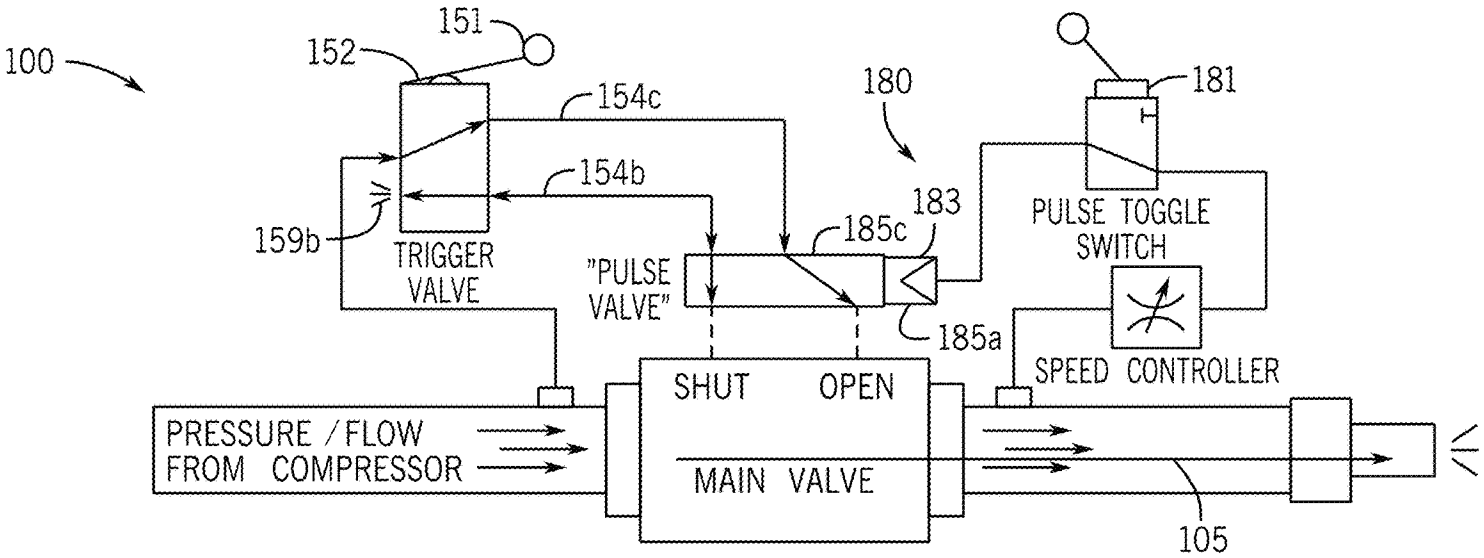
Figure 6C:
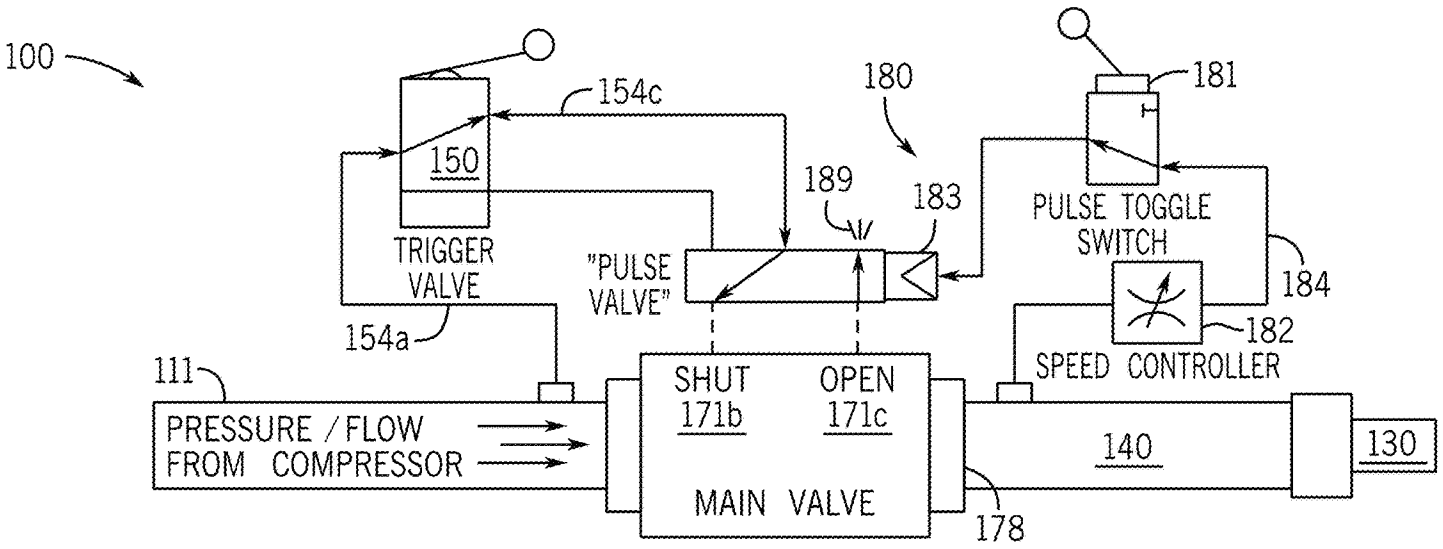

With reference to FIG. 6B, when the switch 181 is moved to the pulse mode selection, and again while the trigger valve 152 is shifted by the trigger 151, the constant pressure delivered to the actuator assembly 150 is directed to the air hose 154*c* then to the port 171*c* of the flow valve 170 to push the piston 175 away from the valve seat 176 to thereby move the flow valve 170 to the open position as shown in FIGS. 6B and 4B such that compressed air flows through the primary flow passage 105 and exits the nozzle 130. In the pulse mode selection position, the pulse control line 184 is open but initially has not yet been pressurized, and consequently, the flow valve 170 remains open. At the same time, due to the flow valve 170 being open, entrapped air at the valve port 171*b* is forced out to atmosphere through the port 159*b* of the actuator assembly 150.

With reference to FIG. 6C, and again while the switch 181 is in the pulse mode selection with the trigger valve 152 shifted by the trigger 151, because pulse control line 184 is opened, the compressed air flow passing through the primary flow path 105 at an outlet side 178 of the flow valve 170, e.g., in the barrel 140, begins to cause the pulse control line 184 to be pressurized. This pressure or air flow fills the pulse control line 184, which air signal passes through the adjustment device 182, e.g., pneumatic speed controller or flow controller such as a needle valve, which throttles flow depending upon how far open or closed they are, and the selector switch 181, e.g., toggle valve, and then into the spool pilot 183 of the controller valve 180. With the spool pilot 183 pressurized a spool within the controller valve 180 shifts, e.g., to an actuated position, and changes the flow paths within the controller valve 180. With the flow paths shifted, the pressure signal from the actuator assembly 150 from the air hose 154*c*, is now directed to the port 171*b* of the flow valve 170 to close the flow valve 170, and the port 171*c* of the flow valve 170 is vented to atmosphere, e.g., via an exhaust port 189 of the controller valve 180. This shuts the flow valve 170 and cuts-off flow to the barrel 140. The adjustment device 182 inline with the pulse control line 184 regulates the amount of air that can pass through, which in turn regulates how quickly the spool pilot 183 is able to pressurize and thereby shift the spool to change flow paths. By reducing the amount flow through the adjustment device 182 the frequency of pulses can effectively be slowed down, or inversely sped up by allowing more air through.

Figure 6D:
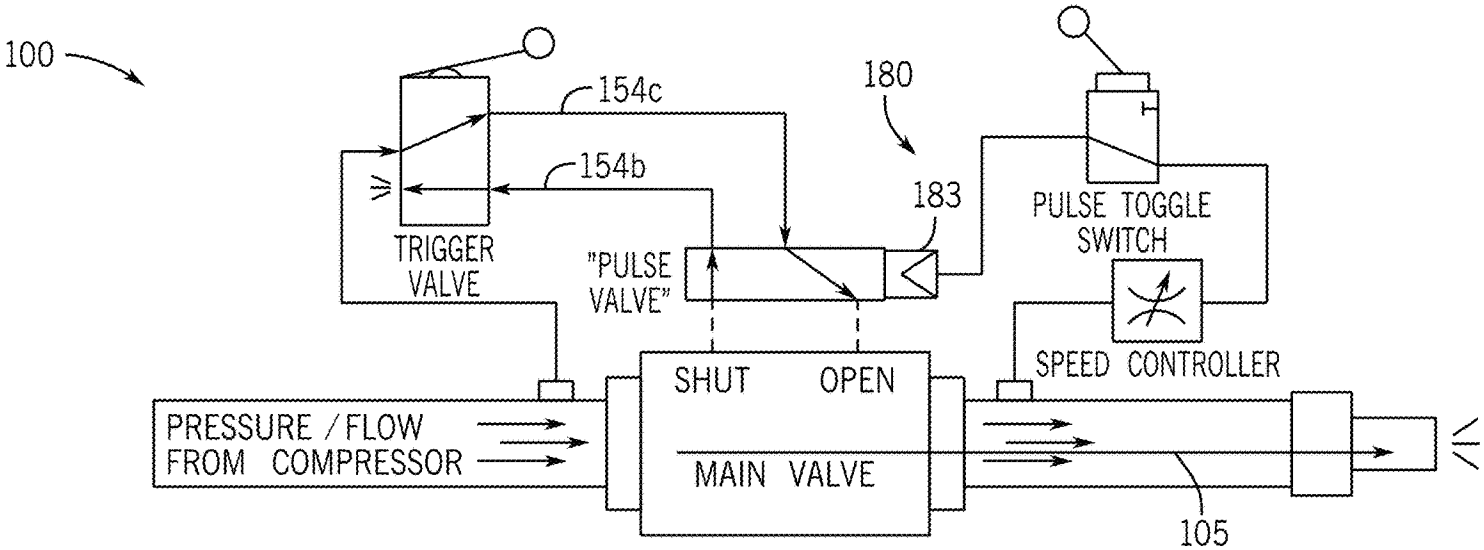

With reference to FIG. 6D, once the flow valve 170 has been shut, no more air enters the barrel 140 and the pressure therein returns to atmospheric. With the barrel 140 now unpressurized, the spool pilot 183 of the controller valve 180 also loses pressure. With the spool pilot 183 no longer pressurized a biasing mechanism, e.g., a spring, of the controller valve 180 may return the spool of the controller valve 180, to its normal or unactuated position and shift the flow path. Once again, the pressure signal from the actuator assembly 150 is directed into the port 171*c* of the flow valve 170 forcing the flow valve 170 open and allowing the compressed air to flow through the primary flow path 105. The process of pressurizing the pulse control line 184 and the steps described in connection with FIG. 6C then repeat, resulting in an automatic pulsing function of the controller valve 180. Thus, due to the spool of the controller valve 180 moving in a reciprocating manner when the trigger 151 is actuated and the switch 181 is in the pulse mode selection, this results in a pulsed compressed airflow being delivered from the pneumatic air excavator 100. The pulsing loop of the controller valve 180 may continue until the actuator assembly 150 is released from being actuated, or until the switch 181, e.g., inline toggle switch, is moved a constant flow mode, for instance as described in connection with FIG. 6F.

Figure 6E:
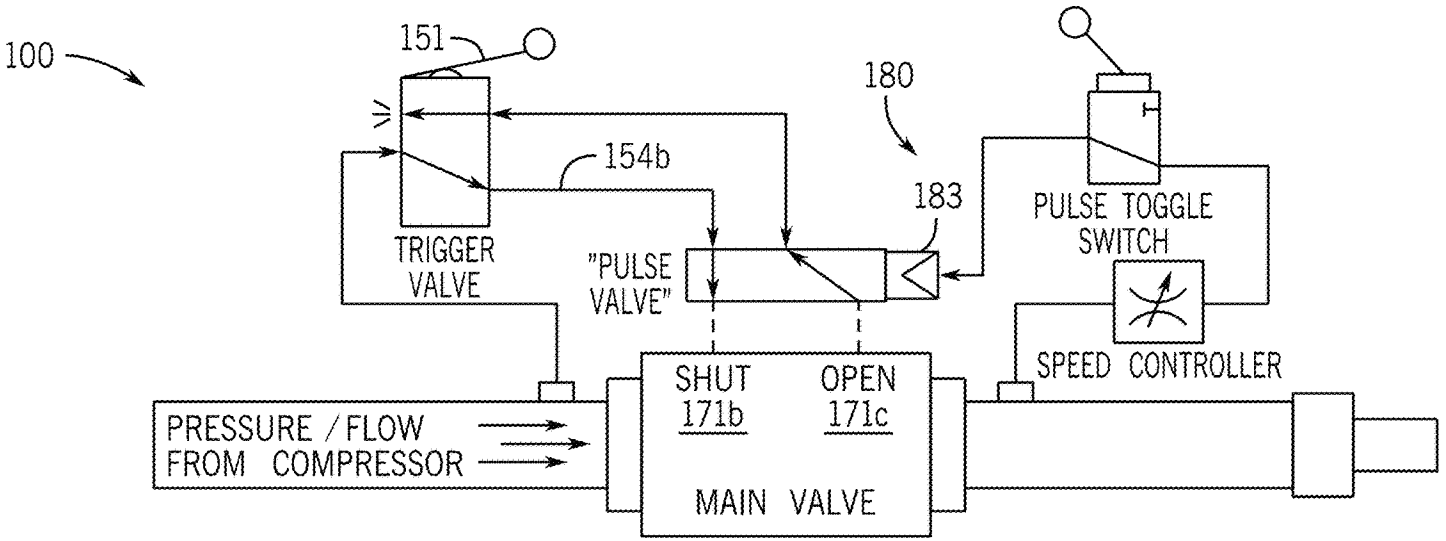

With reference to FIG. 6E, once the actuator assembly 150 has been released, e.g., the trigger 151 is no longer pressed and the trigger valve 152 shifts to its normal position or open position, the flow valve 170 may return to its closed position due to pressurized air from the air hose 154*b* entering port 171*b* and forcing the piston 175 against the valve seat 176 to close the valve 170 to thereby discontinue flow through the primary flow passage 105.

Figure 6F:
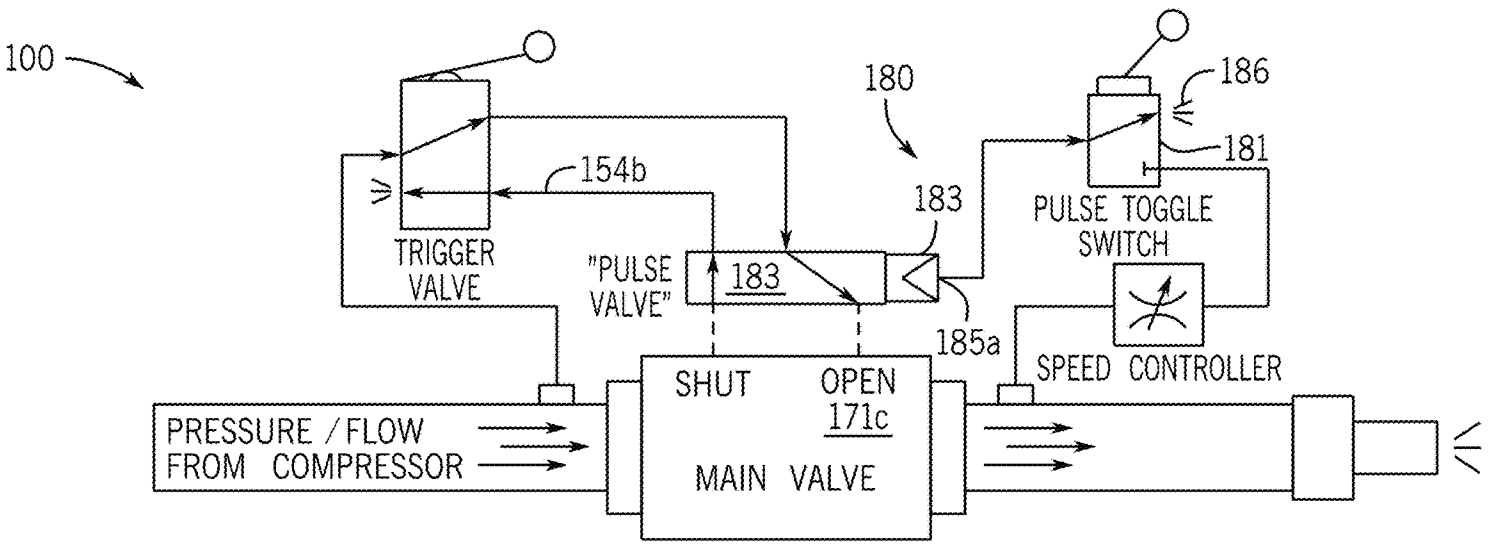

With reference to FIG. 6F, details of the controller valve 180 pulse toggle function are provided, according to implementations of the present disclosure. The purpose of the pulse toggle switch, e.g., switch 181, is to allow the air excavator 100 to operate in either a constant flow or pulsed flow mode as described herein. FIG. 6F represents a pneumatic circuit when the actuator 150 is being depressed, but the pulse toggle switch is in the constant flow position. In this position the pulse toggle switch blocks flow to the spool pilot 183 of the controller valve 180. For instance, the pulse toggle switch 181 may prevent pressure from continuing on through the pulse control line 184 to pressurize the spool pilot 183. Since the spool pilot 183 does not receive a pressure signal it remains in the normal position, meaning that the main valve or flow valve 170 will remain open as long as the trigger valve 152 is depressed to permit airflow through the primary flow passage 105, and the flow valve 170 will close when the trigger valve is released 152. With the pulse toggle switch in the position of FIG. 6F, an exhaust port 186 of the switch 181 may also allow any pressure that is contained within the spool pilot 183 to be vented to atmosphere, via the exhaust port 186 of the switch 181, e.g., through the entry port 185*a* of the spool pilot 183 (this instance is unlikely and could only occur if the pulse toggle switch was toggled from pulse to constant while the gun was in the phase of operation of FIG. 6C).

Figure 7:
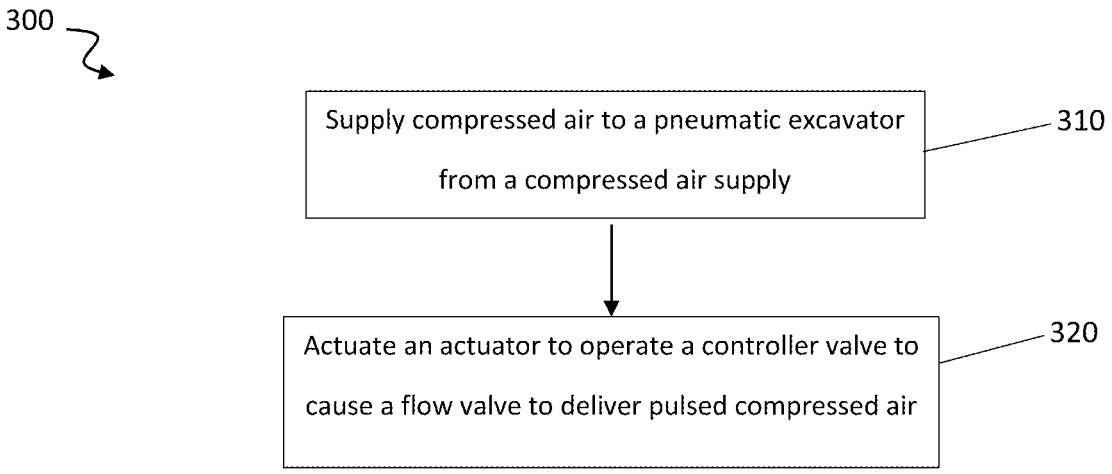
FIG. 7 illustrates a flow diagram of a method of pneumatically actuating the pneumatic air excavator, according to implementations of the present disclosure.

According to implementations of use, as shown in the flow diagram of FIG. 7, a method 300 of delivering pulsed compressed air through a pneumatic excavator may involve constantly supplying compressed air to the pneumatic excavator 100 from a compressed air supply in operation 310, e.g., via the delivery line 111 coupled to a compressor truck. Initially, the compressed air supply is prevented from passing through the barrel 140 and exiting the nozzle 130 due to the flow valve 170 being in a closed position (FIGS. 4A, 6A), and for instance, the piston 175 of the flow valve 170 may seal against a valve seat 176 of the flow valve 170. As provided herein, the air supply from the delivery line 111 may deliver compressed air to the actuator assembly 150, such as via the flexible air hose 154*a* of the actuation conduit 153 coupled between the flow valve 170 and the actuator assembly 150. More particularly, the air hose 154*a* may be fluidly coupled to the flow valve 170 at a port 171*a* positioned upstream of the piston 175 such that the compressed air is permitted to constantly pass through the flexible air hose 154*a* and to the actuator assembly 150 as long as the delivery line 111 is supplied with compressed air. The air hose 154*a* may thus be configured as a constant pressure conduit that is constantly supplied compressed air. In this initial state of the pneumatic excavator 100 when the compressed air is supplied, the actuation switch of the actuator assembly 150 is in the open position and the compressed air from the flexible air hose 154*a* is transmitted through the actuator assembly 150 to the air hose 154*b* of the actuation conduit 153, which in turn transmits the compressed air to port 185*b* of the controller valve 180 fluidly coupled to the port 171*b* of the flow valve 170 to force the piston 175 of the flow valve 170 against the valve seat 176 thereof to pneumatically force the flow valve 170 in a closed position (FIG. 6A), e.g., the compressed air is prevented from passing through the flow valve 170 and the primary flow passage 105.

The method 300 may continue by actuating the actuator assembly 150 to operate the controller valve 180 and cause the flow valve 170 to deliver pulsed compressed air in operation 320, for instance by moving the actuation switch, e.g., by depressing the trigger 151, while the switch 181 of the controller valve 180 is in the pulse mode position. Operation 320 proceeds in phases to deliver the pulsed compressed air. Initially, in a first phase of actuation, a first portion of compressed air is delivered to the flow valve 170 via the controller valve 180 to move the flow valve 170 to the open position (FIGS. 4B, 6B), e.g., by delivering compressed air from the port 185*c* of the controller valve to the port 171*c* of the flow valve to separate the piston 175 from the valve seat 176, and, as a result, a second portion of compressed air passes through the primary flow passage 105 by flowing through the flow valve 170 ingress and egress, through the barrel 140 and exiting the outlet thereof. In a second phase of actuation, the pulse control line 184 of the controller valve 170 is pressurized by the second portion of the compressed air passing through the primary flow passage 105, which causes the spool pilot 183 of the controller valve 180 to be pressurized, and which shifts the controller valve 180 to an actuated position to cause the compressed air to be delivered from port 185*b* to port 171*c* of the flow valve 170 such that the flow valve 170 moves to a closed position (FIG. 6C) and prevents the second portion of compressed air from passing through the flow valve 170, e.g., the egress thereof. For instance, the controller valve 180 may include a spool pilot 183 that is pressurized and causes a spool to move to the actuated position, which may be against the force of a biasing mechanism. In a third phase of actuation, due to the flow valve 170 being closed, the pulse control line 184 and the controller valve 180 are no longer pressurized and the controller valve 180 shifts to an unactuated position to thereby permit the second portion of compressed air to pass through the primary flow passage 105 (FIG. 6D) and again pressurize the pulse control line 184 to then repeat the first and second phases, whereby pulsed compressed air is delivered through the primary flow passage of the pneumatic excavator. In the case of a spool, the lack of pressurization in the spool pilot results in the spool returning to its normal position as the biasing mechanism, e.g., return spring, relaxes.

When the actuator is released, e.g., not actuated, the first portion of compressed air is transmitted from the actuator 150 to the flow valve 170 via the controller valve 180 such that the first portion of compressed air holds the piston 175 of the flow valve 170 in the closed position (FIG. 6E). When the selector switch 181 is moved to a constant flow mode, the controller valve 180 or portion thereof, e.g., spool and spool pilot, may be inactive and may not receive a pressure signal when the actuator 150 is actuated. For instance, when the constant flow mode of operation is selected, the pulse control line and the spool pilot are inactivated and the first portion of compressed air holds the piston in the open position during actuation of the actuator 150 to thereby open the flow valve 170 and permit the second portion of compressed air to pass therethrough and through the primary flow passage 105. In some implementations, the flow valve 170 is a pneumatic valve requiring the delivery of compressed air to one of its ports 171*b* and 171*c* in order to open and close, and accordingly the flow valve 170 may be free of a biasing mechanism such as a return spring.

Due to the actuator assembly 150 being configured to pneumatically actuate the flow valve 170 via the actuation conduit 153, e.g., being configured as an air actuation conduit, the actuator assembly 150 may be remotely arranged from the flow valve 170 as illustrated in the Figures. However, the actuator assembly 150 and its actuation conduit 153 may also be arranged on or integrated with the flow valve 170 while not departing from the other advantageous features of the pneumatic air excavator 100 of the present disclosure.

Pneumatically actuating the pneumatic excavator 100 may provide advantages because use of pressurized air as a means to trigger the flow valve 170 provides an efficient use of pressurized air at the actuator assembly 150 where a small air signal may be used, e.g., via the actuator assembly 150 including the actuation conduit 153, results in a short throw length or relay to cause a large pressure change at the flow valve 170 to cause the flow valve 170 to open and close (FIGS. 6A-6F). A coaxial-style valve as illustrated in these figures, as well as other pneumatic valves such as ball or angled seat, may thus be operated using a small mechanical operator, like the trigger 151, to open the trigger valve 152 of the actuator assembly 150 to cause pressurized air to flow through the actuation conduit 153 to operate the flow valve 170 as provided herein.

Venting may occur during operation of the compressed air excavator 100 to cause opposing pressure to be vented to the atmosphere. For instance, during movement of compressed air through the primary flow passage 105, e.g., while the piston 175 is separated from the valve seat 176, the opposing pressure directed against the piston 175 may be released and discharged or vented through the port 171*b* (FIG. 4B), may proceed through the air hose 154*b* and be exhausted through the exhaust port 159*a* at the actuator assembly 150. Once the trigger 151 is released, the pressure keeping the flow valve 170 open is released from the air hose 154*c*, e.g., the air is vented to atmosphere such as via an exhaust port 159*b* of the actuator assembly 150, and the compressed air is delivered from the actuator assembly 150 back to the air hose 154*b* such that the compressed air forces the piston 175 against the valve seat 176 to seal the flow valve 170 in a closed position. In some implementations, the flow valve 170 may include a mechanical biasing mechanism such as a return spring to facilitate movement of the piston 175 to the closed position. In addition, venting may occur at the controller valve 180 via the exhaust port 189 when the spool of the controller valve 180 shifts the flow paths such that the pressure signal from the air hose 154*c* is shifted to the port 171*b* of the flow valve 170 that closes the flow valve 170, and opposing pressure in the port 171*c* of the flow valve 170 is vented to atmosphere by the exhaust port 189.

In some implementations, the actuator assemblies and the controller valves may be biased such as spring loaded. For instance, depressing the trigger 151 against a spring force may cause trigger valve 152 to shift from its initial or normal position and the flow valve 170 to move to an open or on position as provided herein. When the trigger 151 is released, the spring relaxes and may cause the trigger valve 152 to shift back to its initial or normal position, which may cause the flow valve 170 to move to the closed or off position as provided herein. In the case of the controller valve 180, a spool of the controller valve 180 may be shifted to its normal position as a biasing mechanism, e.g., spring, relaxes, such as during operation of the controller valve 180 in an unpressurized state, as provided herein. In other implementations, one or more actuators or valves of the pneumatic air excavator 100, e.g., of the actuator assembly and/or the controller, may be biased by a solenoid valve.

Various changes may be made in the form, construction and arrangement of the components of the present disclosure without departing from the disclosed subject matter or without sacrificing all of its material advantages. The form described is merely explanatory, and it is the intention of the following claims to encompass and include such changes. Moreover, while the present disclosure has been described with reference to various embodiments, it will be understood that these embodiments are illustrative and that the scope of the disclosure is not limited to them. Many variations, modifications, additions, and improvements are possible. Functionality may be separated or combined in blocks differently in various embodiments of the disclosure or described with different terminology. These and other variations, modifications, additions, and improvements may fall within the scope of the disclosure as defined in the claims that follow.

What is claimed is:

1. A pneumatic excavator configured for delivering pulsed compressed air, comprising:

an actuator;

a controller valve fluidly coupled to the actuator by at least one air conduit;

a flow valve fluidly coupled to the controller valve by at least one port of the flow valve;

a barrel coupled to an egress of the flow valve, wherein an egress of the barrel defines an outlet of the pneumatic excavator; and a pulse control line configured as an air conduit extending between the controller valve and a port of a primary flow passage downstream from an egress of the flow valve, wherein the primary flow passage is defined at least by the flow valve and the barrel, wherein as compressed air from a compressed air supply flows through the primary flow passage, the pulse control line is pressurized by the air and causes a spool pilot of the controller valve to be pressurized and to shift the controller valve to an actuated position to cause the compressed air to be delivered to a port of the at least one port of the flow valve such that the flow valve moves to a closed position and prevents the compressed air from the compressed air supply from flowing through the primary flow passage, and wherein upon the flow valve moving to the closed position, the pulse control line is no longer pressurized and the controller valve shifts to an unactuated position to cause the compressed air to be delivered to another port of the at least one port of the flow valve such that the flow valve opens and permits the compressed air from the compressed air supply to flow through the primary flow passage and again pressurize the pulse control line, whereby pulsed compressed air is delivered through the primary flow passage of the pneumatic excavator.

2. The pneumatic excavator of claim 1, wherein the controller valve further comprises a spool, wherein when the spool pilot is pressurized, the spool is caused to shift to thereby move the controller valve to the actuated position, and wherein when the spool pilot is no longer pressurized, the spool shifts to thereby move the controller valve to the unactuated position.

3. The pneumatic excavator of claim 2, wherein the spool of the controller valve is biased by a biasing mechanism, and when the spool pilot is not pressurized, the spool is in a normal position.

4. The pneumatic excavator of claim 3, wherein the biasing mechanism comprises a return spring.

5. The pneumatic excavator of claim 1, wherein the controller valve further comprises an adjustment device configured to control a pulse rate of the pulsed compressed air.

6. The pneumatic excavator of claim 5, wherein the adjustment device is configured to control an orifice size of the pulse control line.

7. The pneumatic excavator of claim 1, wherein the controller valve further comprises a selector switch configured to move between at least two positions, wherein in a first position of the selector switch, the pneumatic excavator is configured to deliver the pulsed compressed air, and in a second position of the selector switch, the pneumatic excavator is configured to deliver a constant flow of the compressed air from the compressed air supply through the primary flow passage.

8. The pneumatic excavator of claim 7, wherein in during the constant flow of the compressed air through the primary flow passage while the actuator is actuated, the compressed air is transmitted by the at least one air conduit to the at least one port of the flow valve via the controller valve such that the compressed air causes the flow valve to move to the open position to thereby permit air from the compressed air supply to flow through the primary flow passage.

9. The pneumatic excavator of claim 7, wherein during the constant flow of the air through the primary flow passage while the actuator is actuated, the controller valve is not pressurized.

10. The pneumatic excavator of claim 1, wherein actuating the actuator causes the air from the compressed air supply to flow through the primary flow passage.

11. A method of delivering pulsed compressed air through a pneumatic excavator comprising an actuator, a controller valve, and a primary flow passage defined at least by a flow valve, a barrel and a nozzle defining an outlet of the pneumatic excavator, the method comprising:

providing, from a compressed air supply, a constant supply of compressed air to the pneumatic excavator; and actuating the actuator, wherein in a first phase of actuation, the actuator delivers a first portion of compressed air to a port of the flow valve such that the first portion of compressed air moves the flow valve to an open position to thereby open the flow valve and permit a second portion of compressed air to pass through the primary flow passage, wherein in the first phase of actuation, the controller valve is in an unactuated position, wherein in a second phase of actuation, a pulse control line of the controller valve is pressurized by the second portion of the compressed air passing through the primary flow passage and causes the controller valve to be pressurized and to shift to an actuated position to cause the actuator to deliver compressed air to another port of the flow valve such that the flow valve moves to a closed position and prevents the second portion of compressed air to pass through the primary flow passage, and wherein upon the flow valve moving to the closed position, the pulse control line and the controller valve are no longer pressurized such that the controller valve shifts to the unactuated position such that the actuator returns to the first phase of actuation and thereby permits the second portion of compressed air to pass through the primary flow passage and again pressurize the pulse control line, whereby pulsed compressed air is delivered through the primary flow passage of the pneumatic excavator.

12. The method of claim 11, wherein when the actuator is not actuated, the first portion of compressed air is transmitted from the actuator to the flow valve via the controller valve such that the first portion of compressed air holds a piston of the flow valve in the closed position to thereby prevent the second portion of compressed air from passing through the flow valve.

13. The method of claim 11, wherein in the first phase of actuation, the first portion of compressed air is delivered to the port of the flow valve such that the first portion of compressed air holds a piston of the flow valve in the open position, and in the second phase of actuation, the first portion of compressed air is delivered to the another port of the flow valve such that the first portion of compressed air holds the piston in the closed position.

14. The method of claim 11, further comprising using a selector switch to select a pulse mode of operation of the pneumatic excavator such that the pulsed compressed air is provided through the primary flow passage.

15. The method of claim 14, further comprising using the selector switch to select a constant flow mode of operation of the pneumatic excavator, wherein when the constant flow mode of operation is selected, the pulse control line and a spool pilot of the controller valve are inactivated and the first portion of compressed air is delivered to the port of the flow valve and holds a piston of the flow valve in the open position to thereby open the flow valve and permit the second portion of compressed air to pass therethrough and through the primary flow passage.

16. The method of claim 11, further comprising releasing the actuator such that the actuator is not actuated and the first portion of compressed air is transmitted from the actuator to the flow valve and holds a piston of the flow valve in the closed position to thereby prevent the second portion of compressed air from passing through the flow valve.

17. The method of claim 11, further comprising venting the flow valve when the flow valve is in at least one of the open position or the closed position.

* * * * *